US010140938B2

(12) United States Patent
He

(10) Patent No.: US 10,140,938 B2
(45) Date of Patent: Nov. 27, 2018

(54) GIP TYPE LIQUID CRYSTAL DISPLAY DEVICE

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventor: Jian He, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 362 days.

(21) Appl. No.: 14/429,503

(22) PCT Filed: Jul. 25, 2014

(86) PCT No.: PCT/CN2014/083074
§ 371 (c)(1),
(2) Date: Mar. 19, 2015

(87) PCT Pub. No.: WO2015/101028
PCT Pub. Date: Jul. 9, 2015

(65) Prior Publication Data

US 2016/0035299 A1 Feb. 4, 2016

(30) Foreign Application Priority Data

Dec. 31, 2013 (CN) ..... 2013 1 0755459

(51) Int. Cl.
*G09G 3/36* (2006.01)
*G09G 3/20* (2006.01)

(52) U.S. Cl.
CPC ..... *G09G 3/3648* (2013.01); *G09G 3/3677* (2013.01); *G09G 3/2092* (2013.01);
(Continued)

(58) Field of Classification Search
None
See application file for complete search history.

(56) References Cited

U.S. PATENT DOCUMENTS

2006/0267911 A1 11/2006 Jang
2007/0279406 A1* 12/2007 Ishiyama ..... G09G 3/3614 345/212

(Continued)

FOREIGN PATENT DOCUMENTS

CN 1870117 A 11/2006
CN 101122697 A 2/2008

(Continued)

OTHER PUBLICATIONS

First Chinese Office Action Appln. No. 201310755459.8; dated Jul. 13, 2015.

(Continued)

*Primary Examiner* — Amare Mengistu
*Assistant Examiner* — Sarvesh J Nadkarni
(74) *Attorney, Agent, or Firm* — Ladas & Parry LLP

(57) ABSTRACT

A GIP liquid type of crystal display device includes a clock generating unit that provides K scan clock signals to a first driving subunit and K scan clock signals to a second driving subunit respectively according to a scan sequence to make the first/second driving subunit provides driving signals to odd/even numbered rows of gate lines. In a first scan sequence, the time sequence of the scan clock signals to scan the (2N)th row of gate line lags behind that of the scan clock signals to scan the (2N−1)th row of gate line by ½K of a cycle, while in a second scan sequence, the time sequence of (Continued)

the scan clock signals to scan the (2N−1)th row of gate line lags behind that of the scan clock signals to scan the (2N)th row of gate line by ½K of a cycle, wherein N is a natural number, K=2m, and m is a natural number.

19 Claims, 4 Drawing Sheets

(52) U.S. Cl.
CPC ..... *G09G 2300/0413* (2013.01); *G09G 2310/021* (2013.01); *G09G 2310/0283* (2013.01); *G09G 2320/0233* (2013.01)

(56) References Cited

U.S. PATENT DOCUMENTS

| | | | | |
|---|---|---|---|---|
| 2008/0001887 | A1 | 1/2008 | Hong et al. | |
| 2008/0252587 | A1 | 10/2008 | Wang et al. | |
| 2009/0278782 | A1* | 11/2009 | Chen | G09G 3/3677 345/100 |
| 2011/0273417 | A1* | 11/2011 | Shin | G09G 3/20 345/211 |
| 2012/0176351 | A1 | 7/2012 | Hsieh et al. | |
| 2014/0071033 | A1 | 3/2014 | Meng | |
| 2015/0029083 | A1 | 1/2015 | He | |

FOREIGN PATENT DOCUMENTS

| | | | |
|---|---|---|---|
| CN | 101567172 | A | 10/2009 |
| CN | 101577104 | A | 11/2009 |
| CN | 101872593 | A | 10/2010 |
| CN | 202332230 | U | 7/2012 |
| CN | 102881268 | A | 1/2013 |
| CN | 103236248 | A | 8/2013 |
| CN | 103474039 | A | 12/2013 |
| CN | 103700358 | A | 4/2014 |
| CN | 103943075 | A | 7/2014 |
| JP | 2002-244623 | A | 8/2002 |
| TW | 200841312 | A | 10/2008 |

OTHER PUBLICATIONS

Second Chinese Office Action Appln. No. 201310755459.8; dated Dec. 13, 2015.
International Search Report Appln. No. PCT/CN2014/083074; dated Oct. 27, 2014.
Written Opinion of the International Searching Authority Appln. No. PCT/CN2014/083074; dated Oct. 27, 2014.

* cited by examiner

GIP TYPE LIQUID CRYSTAL DISPLAY DEVICE

TECHNICAL FIELD

Embodiments of the present invention relate to a GIP type liquid crystal display device.

BACKGROUND

A liquid crystal display device includes a liquid crystal panel equipped with a plurality of gate lines and a plurality of data lines, a gate driving unit outputting gate signals to the gate lines and a source driving unit outputting data signals to the data lines. With the continuous technical development, various driving technologies with reduced costs, including the Dual-Gate technology and the Gate-In-Panel (GIP) technology, are applied in liquid crystal display products.

The dual-gate technology is a type of driving technology that reduces the quantity of data lines by half and doubles the quantity of gate lines, so that the quantity of source driving ICs is reduced by half and the quantity of gate driving ICs is doubled. Since the unit price of a gate driving IC is lower than that of a source driving IC, the total costs are reduced. However, the dual-gate technology may bring about a problem of undercharge of TFTs.

The GIP technology eliminates gate driving ICs to reduce costs by integrating the gate driving units in the peripheral region of the display area of the LCD panel. For further reduction of costs, some liquid crystal display products employ both the dual-gate technology and the GIP technology.

SUMMARY

At least one embodiment of the present invention provides a GIP type of liquid crystal display device to avoid the problem of poor display effect due to vertical muras readily caused by the employment of both the GIP technology and the dual-gate technology.

At least one embodiment of the present invention provides a GIP type of liquid crystal display device that includes a display unit, a clock generating unit and a gate driving unit with the gate driving unit being connected with the display unit and the clock generating unit respectively. The display unit comprises a plurality of pixel units for image display and a plurality of rows of gate lines, wherein every two rows of the gate lines constitute a gate line group and have a row of pixel units disposed therebetween, an odd numbered row of gate line is connected with pixel units in an adjacent row and odd numbered columns, and an even numbered row of gate line is connected with pixel units in an adjacent row and even columns. The gate driving unit comprises a first driving subunit and a second driving subunit, the first driving subunit being used to provide driving signals to odd numbered rows of gate lines and the second driving subunit being used to provide driving signals to even numbered rows of gate lines. The clock generating unit is used to provide K scan clock signals to the first driving subunit and K scan clock signals to the second driving subunit respectively according to a scan sequence to make the first/second driving subunit provide driving signals to odd/even numbered rows of gate lines. The scan sequence comprises a first scan sequence and a second scan sequence corresponding to odd/even numbered frames or even/odd numbered frames; in the first scan sequence, the phase of the scan clock signal to scan the (2N)th row of gate line lags behind that of the scan clock signal to scan the (2N−1)th row of gate line by ½K of a cycle; in the second scan sequence, the phase of the scan clock signal to scan the (2N−1)th row of gate line lags behind that of the scan clock signal to scan the (2N)th row of gate line by ½K of a cycle, wherein N is a natural number, K=2m, and m is a natural number.

BRIEF DESCRIPTION OF DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

DETAIL DESCRIPTION

In order to make objects, technical details and advantages of the embodiments of the invention apparent, the technical solutions of the embodiments will be described in a clearly and fully understandable way in connection with the drawings related to the embodiments of the invention. It is obvious that the embodiments to be described are only some, not all, of the embodiments of the present invention. Based on the described embodiments herein, those skilled in the art can obtain other embodiment(s), without any inventive work, which should be within the scope of the invention.

The inventor has found that if the GIP technology and the dual-gate technology are both employed, thin film transistors (TFTs) of the pixel units may be undercharged, causing vertical muras that may impair the displaying quality of the liquid crystal display.

Figure 1:
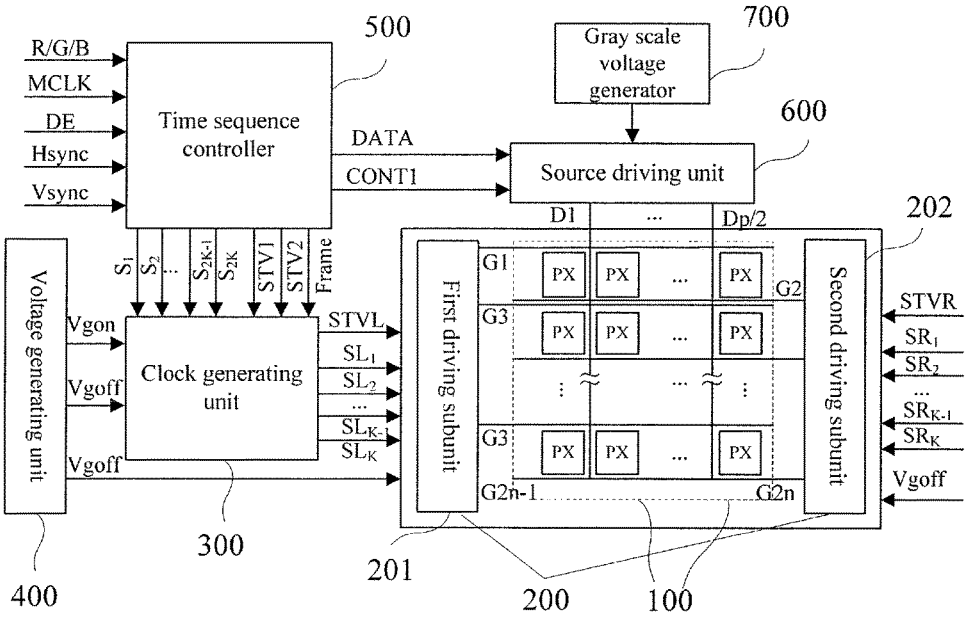
FIG. 1, is a structure diagram of a GIP type of liquid crystal display device provided in an embodiment of the present invention.

Referring to FIG. 1, at least one embodiment of the present invention provides a GIP type of liquid crystal display device, which includes a display unit 100, a gate driving unit 200 and a clock generating unit 300 with the driving unit 200 being connected to the display unit 100 and the generating unit 200 respectively.

The display unit 100 includes a plurality of pixel units for image display and a plurality of rows of gate lines shown in FIG. 1 indicated as G1 to G2*n*, where n is a natural number. In the display unit 100, each gate line group consists of two rows of gate lines with a row of pixel units disposed therebetween, an odd numbered row of gate line is connected with pixel units belonging to an adjacent row and to odd numbered columns, and an even numbered row of gate line is connected with pixel units belonging to an adjacent row and to even numbered columns.

The gate driving unit 200 includes a first driving subunit 201 providing driving signals to odd numbered rows of gate lines and a second driving subunit 202 providing driving signals to even numbered rows of gate lines.

The clock generating unit 300 is used to provide K scan clock signals to the first driving subunit 201 and K scan clock signals to the second driving subunit 202 respectively according to a scan sequence so that the first/second driving subunit 201/202 can provide driving signals to the odd/even numbered rows of gate lines.

The scan sequence includes a first scan sequence and a second scan sequence corresponding to odd/even numbered frames or even/odd numbered frames. In the first scan sequence, the time sequence of the scan clock signals to scan the (2N)th row of gate line lags behind that of the scan clock signals to scan the (2N−1)th row of gate line by ½K of a cycle, while in the second scan sequence, the time sequence of the scan clock signals scan the (2N−1)th row of gate line lags behind that of the scan clock signals to scan the (2N)th row of gate line by ½K of a cycle, where N is a natural number, K=2m, and m is a natural number.

In at least one embodiment of the present invention, the clock generating unit 300 of the display device is capable of providing K scan clock signals to the first driving subunit 201 and K scan clock signals to the second driving subunit 202 respectively according to different scan sequences. In the first scan sequence, the time sequence of the scan clock signals to scan the (2N)th row of gate line lags behind that of the scan clock signals to scan the (2N−1)th row of gate line by ½K of a cycle, while in the second scan sequence, the time sequence of the scan clock signals to scan the (2N−1)th row of gate line lags behind that of the scan clock signals to scan the (2N)th row of gate line by ½K of a cycle. In this way, the luminance of odd/even numbered pixel units can be kept consistent and vertical mural can be reduced so as to achieve improved display effect.

In at least one embodiment of the present invention, the clock generating unit 300 is used to provide K scan clock signals to the first driving subunit 201 and K scan clock signals to the second driving subunit 202 respectively according to a scan sequence. A specific example includes that, among the K scan clock signals provided by the first driving subunit 201, the (i)th scan clock signal is used to have the first driving subunit 201 drive the [(2i−1)+2K*j]th row of gate line, while among the K scan clock signals provided by the second subunit 202, the (i)th scan clock signal is used to have the second driving subunit 202 drive the [2i+2K*j]th row of gate line, where i is a natural number less than or equal to K and j is a positive integer greater than or equal to zero.

For example, FIG. 1 shows the K scan clock signals $SL_1$, $SL_2$, . . . $SL_{K-1}$, $SL_K$ provided to the first driving subunit 201 and the K scan clock signals $SR_1$, $SR_2$, . . . $SR_{K-1}$, $SR_K$ provided to the second driving subunit 202. In an example with K=2, the K scan clock signals provided to the first driving subunit 201 include the first scan clock signal $SL_1$ for the first driving subunit 201 to drive the 1st, 5th, 9th, . . . , [1+4*j]th rows of gate lines and the second scan clock signal $SL_2$ for the first driving subunit 201 to drive the 3rd, 7th, 11th, . . . [3+4*j]th rows of gate lines. Other cases in which K is another positive integer are similar.

In at least one embodiment of the present invention, the clock generating unit 300 provides K scan clock signals to the first driving subunit 201 and K scan clock signals to the second driving subunit 202 respectively, and the scan clock signals each correspond to different rows of gate lines to improve scan efficiency.

In at least one embodiment of the present invention, the display device may further include a voltage generating unit 400.

The voltage generating unit 400 is used to provide a gate on voltage Vgon and a gate off voltage Vgoff to the clock generating unit 300 to make the amplitude values of the scan clock signals provided by the clock generating unit 300 greater than or equal to that of the gate off voltage Vgoff and less than or equal to that of the gate on voltage Vgon; moreover, the voltage generating unit 400 may further provide a gate off voltage Vgoff to the first driving subunit 201 and the second driving subunit 202 to shut off the gates of the pixel units not driven.

In at least one embodiment of the present invention, the display device may further include a time sequence controller 500.

The time sequence controller 500 is used to provide the clock generating unit 300 with 2K control signals, such as $S_1$, $S_2$, . . . $S_{2K-1}$, $S_{2K}$ shown in FIG. 1, as well as a first triggering signal STV1, a second triggering signal STV2 and a scan sequence control signal Frame; moreover, the time sequence controller 500 may further be used to generate data control signals CONT1 and image data DATA according to image signals R/G/B and input control signals controlling the display of the image signals R/G/B.

The input control signals may include a master clock signal MCLK, a data enabling signal DE, a vertical synchronizing signal Vsync and a horizontal synchronizing signal Hsync.

In at least one embodiment of the present invention, the clock generating unit 300 may be further used to: determine the first scan sequence or the second scan sequence as the scan sequence according to the scan sequence control signal; according to the determined scan sequence and the first triggering signal, generate a first scan triggering signal STVL for initiation of the scan done by the first driving subunit 201; and according to the determined scan sequence and the second triggering signal, generate a second scan triggering signal STVR for initiation of the scan done by the second driving subunit 202.

If the first scan sequence is determined as the scan sequence, the second scan triggering signal lags behind the first scan triggering signal in time sequence by ½K of a cycle; if the second scan sequence is determined as the scan sequence, the first scan triggering signal lags behind the second scan triggering signal in time sequence by ½K of a cycle.

In at least one embodiment of the present invention, the clock generating unit 300 is further used to generate 2K scan clock signals in one-to-one correspondence with the 2K control signals according to the determined scan sequence, the first scan triggering signal, the second scan triggering signal and the 2K control signals; the phase of the first one of the scan clock signals provided to the first driving subunit 201 lags behind that of the first scan triggering signal by ½K of a cycle and the phase of the first one of the scan clock signals provided to the second driving subunit 202 lags behind that of the second scan triggering signal by ½K of a cycle.

In at least one embodiment of the present invention, the display device may further include a source driving unit 600, which is connected with the time sequence controller 500 and the display unit 100 respectively, and used to provide image data voltages corresponding to image data to the display unit 100 according to the data control signal CONT1 and the image data DATA provided by the time sequence controller 500.

In at least one embodiment of the present invention, as for an example of the display unit with n rows of and p columns of pixel units, there exist data lines D1 to Dp/2. A specific example of providing image data voltages corresponding to image data DATA to the display unit 100 is to provide image data voltages corresponding to image data DATA to data lines D1 to Dp/2 shown in FIG. 1.

In at least one embodiment of the present invention, the display device may further include a gray scale voltage generator 700.

The gray scale voltage generator 700 is connected with the source driving unit 600 and provides it with a gamma reference voltage.

At least one embodiment of the present invention provides a display device. The clock generating unit of the display device is capable of providing K scan clock signals to the first driving subunit and K scan clock signals to the second driving subunit respectively according to different scan sequences. In the first scan sequence, the time sequence of the scan clock signals to scan the (2N)th row of gate line lags behind that of the scan clock signals to scan the (2N−1)th row of gate line by ½K of a cycle, while in the second scan sequence, the time sequence of the scan clock signals to scan the (2N−1)th row of gate line lags behind that of the scan clock signals to scan the (2N)th row of gate line by ½K of a cycle. In this way, the luminance of odd/even numbered pixel units can be kept consistent and vertical muras can be reduced so as to achieve improved display effect.

In order to explain embodiments of the present invention in more detail, an example with K=2 is as follows.

Figure 2:
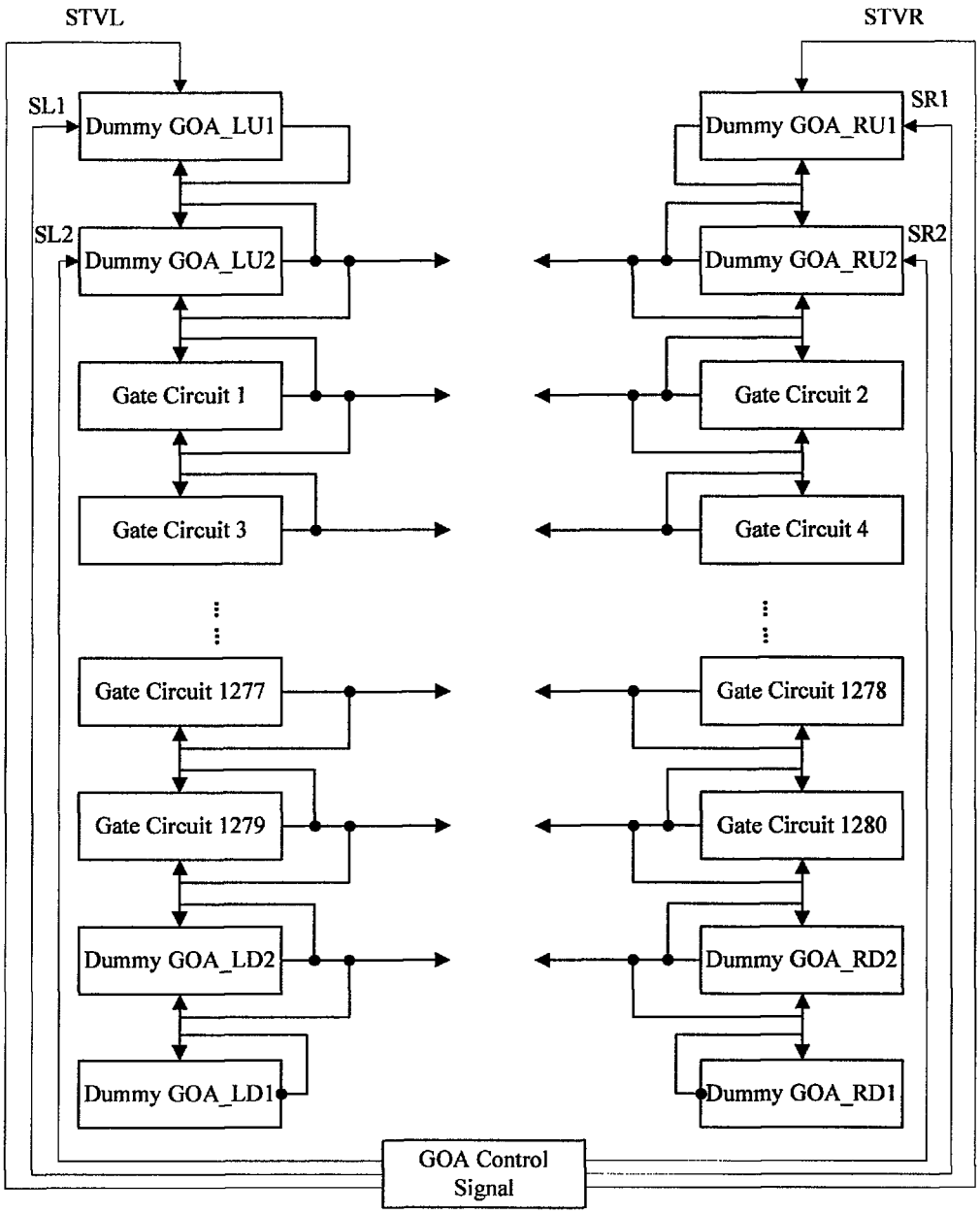
FIG. 2 is a schematic diagram to illustrate that a first driving subunit and a second driving subunit drive individual gate lines correspondingly with K=2 according to an embodiment of the present invention.

The clock generating unit 300 provides scan clock signals SL1 and SL2 as well as the first scan triggering signal STVL to the first driving subunit and provides the scan clock signals SR1 and SR2 as well as the second scan triggering signal STVR to the second driving subunit. The first driving subunit and the second driving subunit drive corresponding gate lines, as can be seen from the schematic diagram of FIG. 2.

Figure 3:
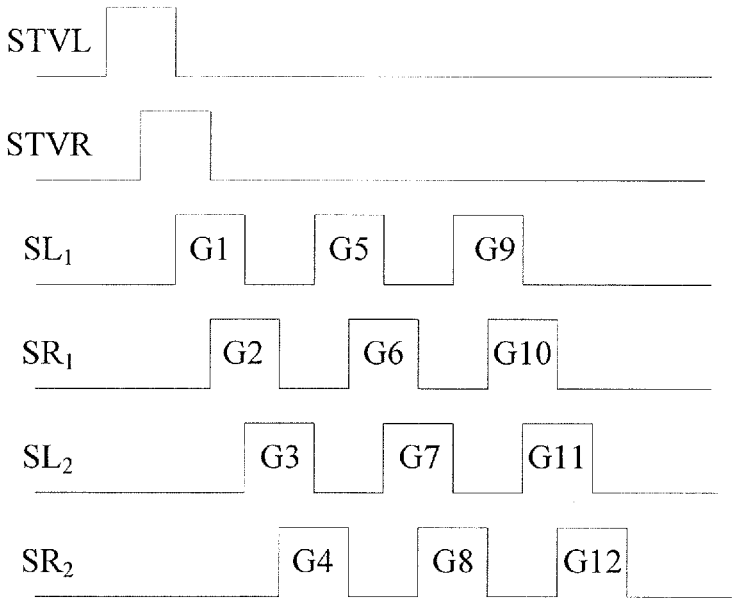
FIG. 3 is a diagram illustrating the time sequence of individual signals for the scan performed in the first scan sequence according to an embodiment of the present invention.

In the first scan sequence, the time sequence of individual signals is as shown in FIG. 3; the phase of the second scan triggering signal STVR lags behind that of the first scan triggering signal STVL by ¼ of a cycle. The phase of the scan clock signal SL1 lags behind that of the first scan triggering signal STVL by ½ of a cycle, the phase of the scan clock signal SR1 lags behind that of second scan triggering signal STVR by ½ of a cycle, the phase of the scan clock signal SR1 lags behind that of the scan clock signal SL1 by ¼ of a cycle, and the phase of the scan clock signal SR2 lags behind that of the scan clock signal SL2 by ¼ of a cycle.

Figure 4:
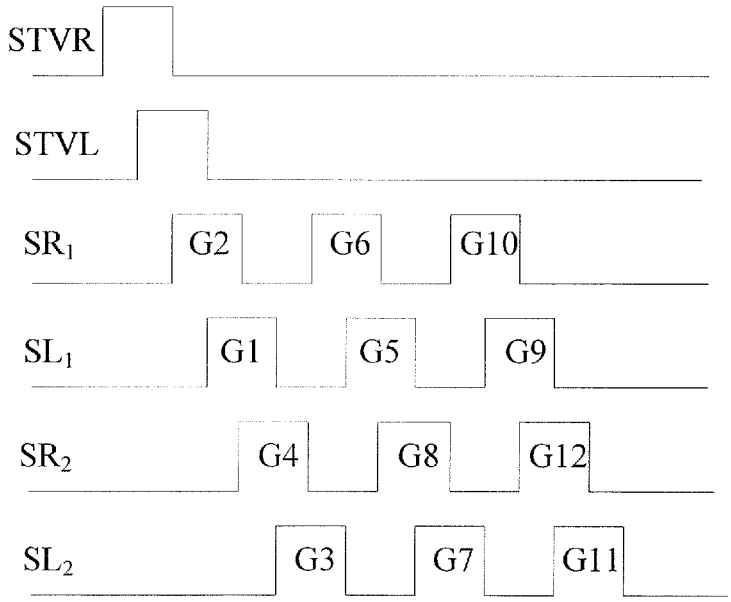
FIG. 4 is a diagram illustrating the time sequence of individual signals for the scan performed in the second scan sequence according to an embodiment of the present invention.

In the second scan sequence, the time sequence of individual signals is as shown in FIG. 4; the phase of the first scan triggering signal STVL lags behind that of the second scan triggering signal STVR by ¼ of a cycle. The phase of the scan clock signal SR1 lags behind that of the second scan triggering signal STVR by ½ of a cycle, the phase of the scan clock signal SL1 lags behind that of first scan triggering signal STVL by ½ of a cycle, the phase of the scan clock signal SL1 lags behind that of the scan clock signal SR1 by ¼ of a cycle, and the phase of the scan clock signal SL2 lags behind that of the scan clock signal SR2 by ¼ of a cycle.

Figure 5:
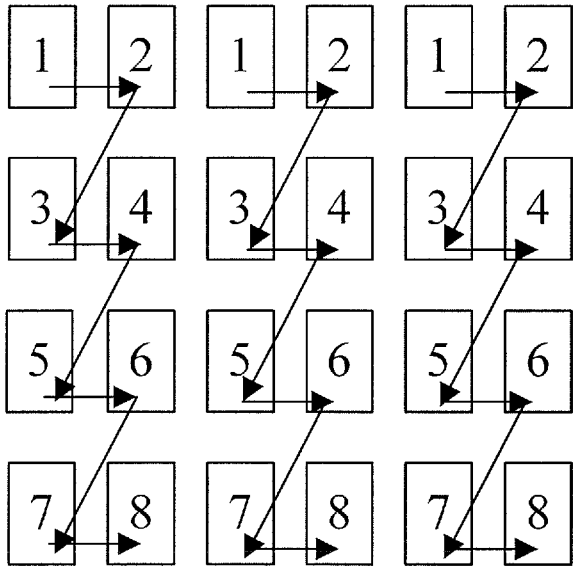
FIG. 5 is a diagram illustrating the scan in the first sequence taking a frame as an unit according to an embodiment of the present invention.
Figure 6:
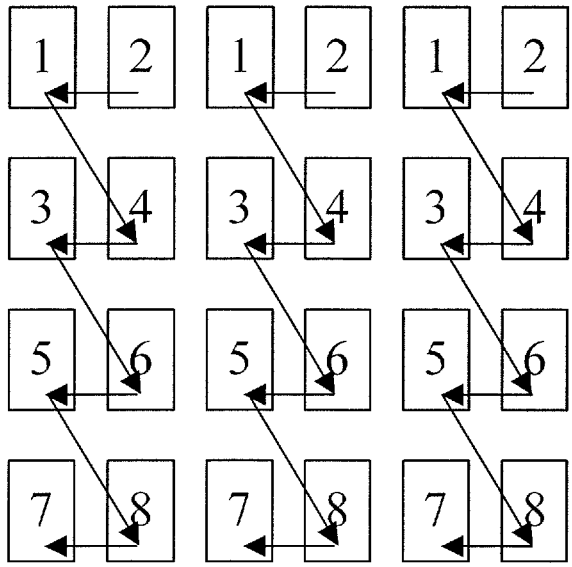
FIG. 6 is a diagram illustrating the scan in the second sequence taking a frame as an unit according to an embodiment of the present invention.

Referring to FIG. 5 and FIG. 6, the setting of the scan sequence to carry out scan will be described in the following with a frame as a cycle.

For example, the display unit 100 includes a plurality of pixel units arranged in n rows and p columns. Correspondingly, the display unit 100 further includes a plurality of gate lines G1 to G2*n*, a plurality of data lines D1 to Dp/2 and n*p pixels PX. The individual pixel units are formed at the intersections of the gate lines G1 to G2*n* and the data lines D1 to Dp/2 to display images. As for the (t)th row of pixel units, the display of images is controlled by the gate lines G2*t*−1 and G2*t*; the display in odd numbered pixel units, such as 1, 3, 5 . . . , among the p pixel units in the (t)th row is controlled by the G2*t*−1 and the display in even numbered pixel units, such as 2, 4, 6 . . . , among the p pixel units in the (t)th row is controlled by the G2*t*. In FIG. 4 and FIG. 5, the odd numbered pixel units in the 1st row are marked as 1 to indicate that those pixel units are driven by the gate line G1, while the odd numbered pixel units in the 2nd row are marked as 2 to indicate that those pixel units are driven by G2, and so on.

In a liquid crystal display device that employs both the dual-gate technology and the GIP technology, the odd and even numbered frames are of the same scan sequence. In an example with gate lines G1 to G8, the scan sequence is as follows:

Odd numbered frames: G1→G2→G3→G4→G5→G6→G7→G8

Even numbered frames: G1→G2→G3→G4→G5→G6→G7→G8

This may cause a problem that odd numbered pixel units are undercharged while even numbered pixel units are charged sufficiently so that the luminance of pixel units in odd numbered columns is inconsistent with that of pixel units in even numbered columns, resulting in vertical muras.

By contrast, in at least one embodiment of the present invention, odd numbered frames are set in the first scan sequence, while even numbered frames are set in the second scan sequence as below:

Odd numbered frames: G1→G2→G3→G4→G5→G6→G7→G8

Even numbered frames: G2→G1→G4→G3→G6→G5→G8→G7

In at least one embodiment of the present invention, at odd numbered frames, gate lines G1 to G8 are scanned in the first scan sequence to make the odd numbered pixel units undercharged and even numbered pixel units charged sufficiently, while, at even numbered frames, gate lines G1 to G8 are scanned in the second scan sequence to make odd numbered pixel units charged sufficiently and even numbered pixel units undercharged. The luminance of odd numbered pixel units is kept consistent with that of even numbered pixel units with time, so that the problem of vertical muras is solved to improve display effect.

What are described above is related to the illustrative embodiments of the present invention only and not limitative to the scope of the present invention, the scopes of the present invention are defined by the accompanying claims.

The present application claims priority of China patent application No. 201310755459.8 filed on Dec. 31, 2013, which is incorporated herein by reference in its entirety as part of the present disclosure.

The invention claimed is:

1. A Gate-In-Panel (GIP) type of liquid crystal display device, comprising a display unit, a clock generator and a gate driving unit, wherein the gate driving unit is connected with the display unit and the clock generator respectively;

the display unit comprises a plurality of pixel units for image display and a plurality of rows of gate lines, every two rows of the gate lines constitute a gate line group and have a row of pixel units disposed therebetween, an odd numbered row of the gate line is connected with pixel units in an adjacent row and odd numbered columns, and an even numbered row of the gate line is connected with pixel units in an adjacent row and even columns;

the gate driving unit comprises a first driver and a second driver, the first driver is used to provide driving signals to odd numbered rows of the gate lines and the second driver is used to provide driving signals to even numbered rows of the gate lines;

the clock generator is used to provide K scan clock signals to the first driver and K scan clock signals to the second driver respectively according to a scan sequence to make the first/second driver provide driving signals to odd/even numbered rows of the gate lines;

scan sequences of odd numbered frames and even numbered frames are different, the scan sequence comprises a first scan sequence and a second scan sequence corresponding to the odd/even numbered frames or the even/odd numbered frames; in the first scan sequence, the phase of the scan clock signals to scan the (2N)th row of the gate line lags behind that of the scan clock signals to scan the (2N−1)th row of the gate line by ½K of a cycle; in the second scan sequence, the phase of the scan clock signals to scan the (2N−1)th row of the gate line lags behind that of the scan clock signals to scan the (2N)th row of the gate line by ½K of a cycle, where N is a natural number, K=2m, and m is a natural number.

2. The display device of claim 1, wherein an (i)th one of the K scan clock signals provided to the first driver is configured to make the first driver drive the [(2i−1)+2K*j]th row of the gate line;

an (i)th one of the K scan clock signals provided to the second driver is used to make the second driver drive the [2i+2K*j]th row of the gate line; and wherein i is a natural number less than or equal to K and j is a positive integer larger than or equal to zero.

3. The display device of claim 2, further comprising:

a voltage generator configured for providing a gate on voltage Vgon and a gate off voltage Vgoff to the clock generator that provides the scan clock signals with amplitude values greater than or equal to that of the gate off voltage Vgoff and less than or equal to that of the gate on voltage Vgon, and providing the gate off voltage Vgoff to the first driver and the second driver to shut off the gates of the pixel units not driven.

4. The display device of claim 2, further comprising a time sequence controller, wherein the time sequence controller is configured to provide 2K control signals, a first triggering signal, a second triggering signal and a scan sequence control signal to the clock generator; and the time sequence controller is configured to further generate data control signals and image data according to image signals and input control signals controlling the image signals.

5. The display device of claim 4, wherein the clock generator is further configured to:

determine the first scan sequence or the second scan sequence as the scan sequence according to the scan sequence control signal; and generate a first scan triggering signal for initiation of the scan done by the first driver, according to the scan sequence and the first triggering signal, and generate a second scan triggering signal for initiation of the scan done by the second driver, according to the determined scan sequence and the second triggering signal; and wherein if the first scan sequence is determined as the scan sequence, the time sequence of the second scan triggering signal lags behind that of the first scan triggering signal by ½K of a cycle; if the second scan sequence is determined as the scan sequence, the time sequence of the first scan triggering signal lags behind that of the second scan triggering signal by ½K of a cycle.

6. The display device of claim 5, wherein the clock generator is further configured to generate the 2K scan clock signals in one-to-one correspondence with the 2K control signals, according to the determined scan sequence, the first scan triggering signal, the second scan triggering signal and the 2K control signals; and wherein a phase of the 1st one of the scan clock signals provided to the first driver lags behind that of the first scan triggering signal by ½K of a cycle, and a phase of the 1st one of the scan clock signals provided to the second driver lags behind that of the second scan triggering signal by ½K of a cycle.

7. The display device of claim 4, further comprising a source driver, wherein the source driver is connected with the source driver and the display unit respectively; and the source driver is configured to provide, according to the data control signals and the image data provided by the source driver, image data voltages corresponding to the image data to the display unit.

8. The display device of claim 7, further comprising a gray scale voltage generator, wherein the gray scale voltage generator is connected with the source driver and used to provide a gamma reference voltage to it.

9. The display device of claim 1, further comprising:

a voltage generator configured for providing a gate on voltage Vgon and a gate off voltage Vgoff to the clock generator that provides the scan clock signals with amplitude values greater than or equal to that of the gate off voltage Vgoff and less than or equal to that of the gate on voltage Vgon, and providing the gate off voltage Vgoff to the first driver and the second driver to shut off the gates of the pixel units not driven.

10. The display device of claim 9, further comprising a time sequence controller, wherein the time schedule controller is configured to provide 2K control signals, a first triggering signal, a second triggering signal and a scan sequence control signal to the clock generator; and the time sequence controller is configured to further generate data control signals and image data according to image signals and input control signals controlling the image signals.

11. The display device of claim 10, wherein the clock generator is further configured to:

determine the first scan sequence or the second scan sequence as the scan sequence according to the scan sequence control signal; and generate a first scan triggering signal for initiation of the scan done by the first driver, according to the scan sequence and the first triggering signal, and generate a second scan triggering signal for initiation of the scan done by the second driver, according to the determined scan sequence and the second triggering signal; and wherein if the first scan sequence is determined as the scan sequence, the time sequence of the second scan triggering signal lags behind that of the first scan triggering signal by ½K of a cycle; if the second scan sequence is determined as the scan sequence, the time sequence of the first scan triggering signal lags behind that of the second scan triggering signal by ½K of a cycle.

12. The display device of claim 11, wherein the clock generator is further configured to generate the 2K scan clock signals in one-to-one correspondence with the 2K control signals, according to the determined scan sequence, the first scan triggering signal, the second scan triggering signal and the 2K control signals; and wherein a phase of the 1st one of the scan clock signals provided to the first driver lags behind that of the first scan triggering signal by ½K of a cycle, and a phase of the 1st one of the scan clock signals provided to the second driver lags behind that of the second scan triggering signal by ½K of a cycle.

13. The display device of claim 10, further comprising a source driver, wherein the source driver is connected with the source driver and the display unit respectively; and the source driver is configured to provide, according to the data control signals and the image data provided by the source driver, image data voltages corresponding to the image data to the display unit.

14. The display device of claim 13, further comprising a gray scale voltage generator, wherein the gray scale voltage generator is connected with the source driver and used to provide a gamma reference voltage to it.

15. The display device of claim 1, further comprising a time sequence controller, wherein the time sequence controller is configured to provide 2K control signals, a first triggering signal, a second triggering signal and a scan sequence control signal to the clock generator; and the time sequence controller is configured to further generate data control signals and image data according to image signals and input control signals controlling the image signals.

16. The display device of claim 15, wherein the clock generator is further configured to:

determine the first scan sequence or the second scan sequence as the scan sequence according to the scan sequence control signal; and generate a first scan triggering signal for initiation of the scan done by the first driver, according to the scan sequence and the first triggering signal, and generate a second scan triggering signal for initiation of the scan done by the second driver, according to the determined scan sequence and the second triggering signal; and wherein if the first scan sequence is determined as the scan sequence, the time sequence of the second scan triggering signal lags behind that of the first scan triggering signal by ½K of a cycle; if the second scan sequence is determined as the scan sequence, the time sequence of the first scan triggering signal lags behind that of the second scan triggering signal by ½K of a cycle.

17. The display device of claim 16, wherein the clock generator is further configured to generate the 2K scan clock signals in one-to-one correspondence with the 2K control signals, according to the determined scan sequence, the first scan triggering signal, the second scan triggering signal and the 2K control signals; and wherein a phase of the 1st one of the scan clock signals provided to the first driver lags behind that of the first scan triggering signal by ½K of a cycle, and a phase of the 1st one of the scan clock signals provided to the second driver lags behind that of the second scan triggering signal by ½K of a cycle.

18. The display device of claim 15, further comprising a source driver, wherein the source driver is connected with the source driver and the display unit respectively; and the source driver is configured to provide, according to the data control signals and the image data provided by the source driver, image data voltages corresponding to the image data to the display unit.

19. The display device of claim 18, further comprising a gray scale voltage generator, wherein the gray scale voltage generator is connected with the source driver and used to provide a gamma reference voltage to it.

* * * * *